United States Patent [19]

Hamby et al.

[11] 4,083,758

[45] Apr. 11, 1978

[54] PROCESS FOR REGENERATING AND FOR RECOVERING METALLIC COPPER FROM CHLORIDE-CONTAINING ETCHING SOLUTIONS

[75] Inventors: Wayne D. Hamby, Pleasant Grove; Marvin Dale Slade, Maesar, both of Utah

[73] Assignee: Criterion, Orem, Utah

[21] Appl. No.: 727,172

[22] Filed: Sep. 27, 1976

[51] Int. Cl.[2] ..... C25C 1/12; B08B 7/04; C23G 1/36

[52] U.S. Cl. ..... 204/106; 423/24; 156/642; 134/10

[58] Field of Search ..... 423/24, 32; 75/101 BE, 75/117; 204/106-108; 134/10; 156/642, 666; 252/79.5

[56] References Cited

U.S. PATENT DOCUMENTS

| | | | |
|---|---|---|---|
| 3,216,873 | 11/1965 | Jones | 156/642 |
| 3,224,873 | 12/1965 | Swanson | 204/106 |
| 3,440,036 | 4/1969 | Spinney | 423/24 |
| 3,761,249 | 9/1973 | Ritcey | 423/24 |
| 3,844,857 | 10/1974 | Chiang | 156/642 |
| 3,971,652 | 7/1976 | Bryson | 423/24 |
| 3,981,966 | 9/1976 | Baucom | 423/24 |

OTHER PUBLICATIONS

Hzkovitch et al "Copper Removal from Thompson Nickel Anolyte by Solvent Extraction" *C.I.M. Bulletin*, Jan. 1974, pp. 92-96.

Yannopoulos et al, Editors *Extractive Metallurgy of Copper*, AIME, N.Y., (1976), vol. II, pp. 1025-1038.

*Solvent Extraction* (Proceedings of I.S.E.C. 1971), vol. II, Society of Chemical Industry, London, 1971, pp. 1383, 1384.

*Primary Examiner*—O. R. Vertiz
*Assistant Examiner*—Brian E. Hearn
*Attorney, Agent, or Firm*—Mallinckrodt & Mallinckrodt

[57] ABSTRACT

Copper values are recovered in metallic form from a solution containing such values along with chloride ions by, first, selectively removing the chloride ions from the solution, and then electrowinning the copper from the chloride-free solution. The process is particularly useful in recovering copper values from etching solutions in a metallic form, such as "wire-grade" metallic copper, that is available for fabrication into commercial copper products. The process is preferably applied to ammoniacal etching solutions derived from the manufacture of printed electronic circuit boards. As so applied, the chlorides are selectively removed by liquid-liquid extraction procedures, resulting in a substantially chloride-free, acidic stripping solution containing the copper values, which solution is subjected to electrolysis for winning copper metal. The aqueous raffinate from the extraction stage is treated for the removal of residual organic and is available for reuse as an etching solution when brought up to the necessary strength by addition of ammonia.

8 Claims, 1 Drawing Figure

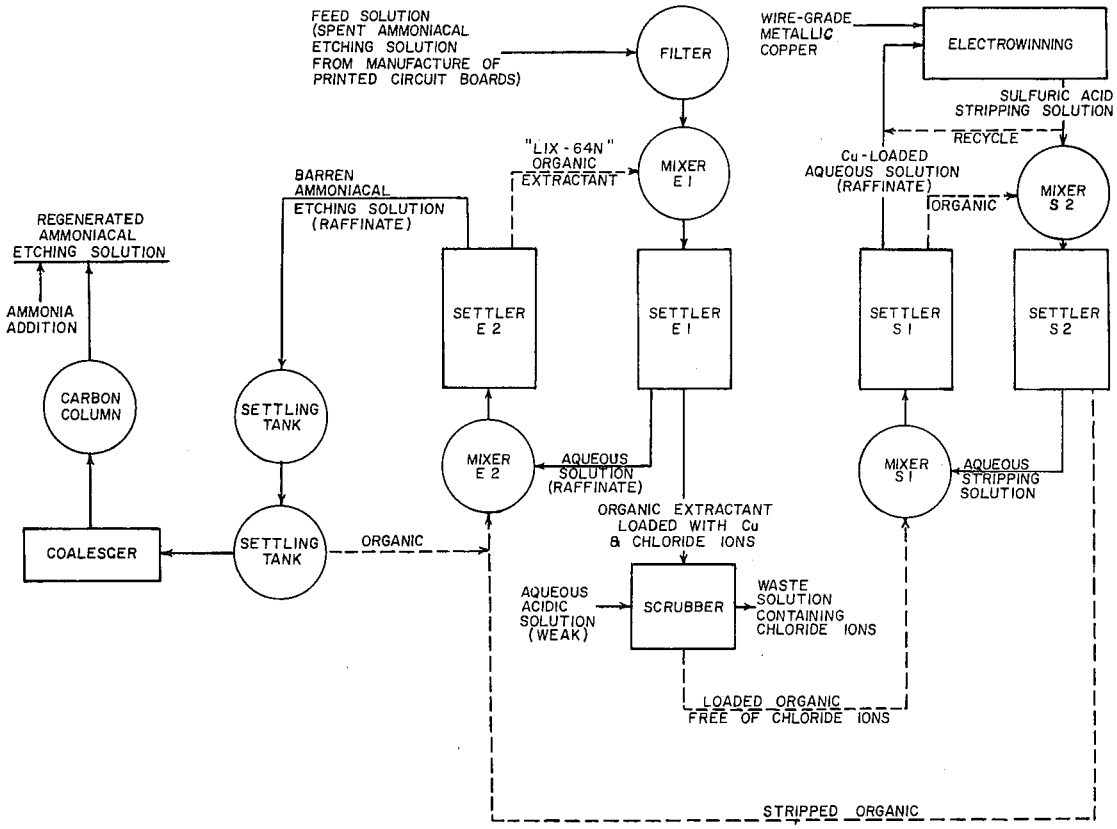

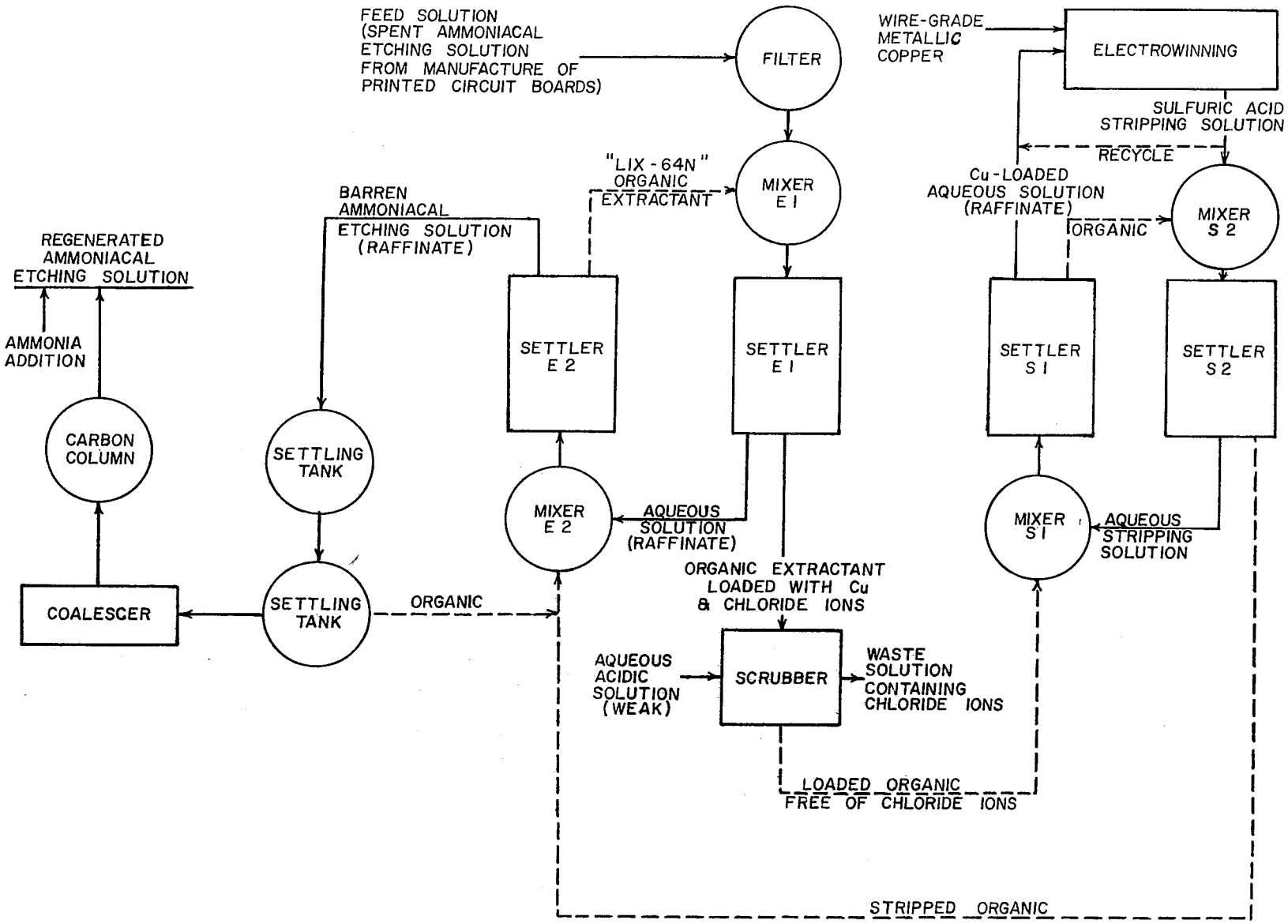
ELECTROWINNING
SULFURIC ACID STRIPPING SOLUTION
RECYCLE
MIXER S 2
SETTLER S 2
ORGANIC
AQUEOUS STRIPPING SOLUTION
WIRE-GRADE METALLIC COPPER
Cu-LOADED AQUEOUS SOLUTION (RAFFINATE)
SETTLER S 1
MIXER S 1
WASTE SOLUTION CONTAINING CHLORIDE IONS
LOADED ORGANIC FREE OF CHLORIDE IONS
STRIPPED ORGANIC
FILTER
MIXER E 1
SETTLER E 1
ORGANIC EXTRACTANT LOADED WITH Cu & CHLORIDE IONS
SCRUBBER
"LIX-64N" ORGANIC EXTRACTANT
AQUEOUS SOLUTION (RAFFINATE)
AQUEOUS ACIDIC SOLUTION (WEAK)
FEED SOLUTION (SPENT AMMONIACAL ETCHING SOLUTION FROM MANUFACTURE OF PRINTED CIRCUIT BOARDS)
SETTLER E 2
MIXER E 2
BARREN AMMONIACAL ETCHING SOLUTION (RAFFINATE)
ORGANIC
SETTLING TANK
SETTLING TANK
REGENERATED AMMONIACAL ETCHING SOLUTION
AMMONIA ADDITION
CARBON COLUMN
COALESCER

PROCESS FOR REGENERATING AND FOR RECOVERING METALLIC COPPER FROM CHLORIDE-CONTAINING ETCHING SOLUTIONS

BACKGROUND OF THE INVENTION

1. Field

The invention is in the field of processes for recovering dissolved metal values from solutions containing same, especially etching solutions.

2. State of the Art

There are many known processes for recovering dissolved copper values from solutions containing same. Most of these are concerned with the recovery of copper values from pregnant leach solutions derived by leaching sulfide copper ore materials with a weak sulfuric acid lixiviant. The most commonly employed process in this connection is the so-called "cementation" of metallic copper on metallic iron employed as a precipitant, followed by pyrometallurgical and electrolytic purification of the precipitated copper. However, electrowinning of dissolved copper directly from such pregnant leach solutions has also been employed, though that is not normally an economic procedure. A process which has received considerable attention recently in connection with the recovery of copper values from ammoniacal leach solutions involves liquid-liquid extraction of the copper values, utilizing a so-called "LIX" reagent produced by General Mills Chemicals, Inc., followed by electrowinning of metallic copper from the aqueous, acidic, stripping solution.

Solutions containing copper values are produced when metallic copper is subjected to the etching action or alkaline etching solutions. Efforts have been made in the past to remove the dissolved copper values from spent etching solutions, either to regenerate such solutions for reuse or to recover the metal values or both. An example of such a process, as applied to spent chromic acid etching solutions derived from the manufacture of printed electronic circuit boards, is that disclosed by U.S. Pat. No. 3,531,262 issued to Robert R. Dougherty on Sept. 29, 1970 for "Treatment of Used Chromic Acid Etching Solutions by Extraction With Acetone". But, so far as we are aware, there has heretofore been no commercially feasible, similar process for removing and recovering dissolved copper values from ammoniacal etching solutions, which solutions differ from other pregnant ammoniacal solutions in that they contain chlorides. we have found that the presence of chloride ions in an electrolyte is dangerous, because of the evolution of chlorine gas during electrolysis.

Considerable quantities of copper-containing, ammoniacal etching solutions are sent to waste by manufacturers of printed electronic circuit boards despite recognition by the art that it is advantageous to regenerate etching solutions and recover the etched copper values therefrom. This has created pollution problems and considerable expense for etching solution. Although in some instances copper values have been precipitated from such solutions with lime, as copper oxides, and have been used in food processing and wood treating industries, this has not proven to be an entirely satisfactory solution to the problems presented.

Objectives

It was a principal objective of the present invention to enable spent ammoniacal etching and like solutions containing chlorides to be effectively regenerated, along with recovery of contained copper values as "wire-grade" metallic copper.

SUMMARY OF THE INVENTION

In accordance with the invention, the foregoing objectives are achieved by treating such spent ammoniacal and like solutions for the selective removal of chloride ions, and, subsequently, electrolytically recovering dissolved copper values from the chloride-free solution.

We have found that a spent, ammoniacal etching solution, particularly as derived from the manufacture of printed electronic circuit boards, can be effectively processed by liquid-liquid extraction of the contained copper values, utilizing a "LIX" reagent in an organic vehicle as the extractant, despite the presence of chloride ions. We have also found that these chloride ions can be easily removed from the organic extract without detriment to the stripping of copper ions therefrom, by scrubbing such extract with an aqueous scrubber solution which is only slightly acidic as compared to the aqueous stripping solution. The resulting organic extract is then stripped in the usual manner to provide a raffinate solution substantially free of chloride ions, and such raffinate solution is subjected to an electrowinning procedure for recovering the copper values in the form of "wire-grade" metallic copper.

The resulting barren electrolyte solution is relatively strong in sulfuric acid and is used as stripping solution for the Cu-loaded organic extract. The raffinate from the extraction stage or stages is treated for the removal of residual organic and becomes the regenerated ammoniacal etching solution, which, after being brought up to required strength by the addition of ammonia, can be reused for etching purposes.

THE DRAWING

Procedures typical of the invention and constituting the best mode presently contemplated of carrying it out in actual practice are illustrated in the accompanying drawing in which the single FIGURE is a flow sheet showing treatment of a spent ammoniacal etching solution from the manufacture of electronic circuit boards.

DETAILED DESCRIPTION OF THE ILLUSTRATED EMBODIMENT

The specified feed solution is made up primarily of ammonium hydroxide and ammonium chloride and typically contains from 16 to 24 ounces of copper values per gallon, with about 10 to 50 parts per million of lead and traces of tin.

The procedures and equipment preferably utilized, as indicated by the flowsheet, are largely known in connection with the recovery of metallic copper from scrap materials, and are described in some detail in a booklet published by General Mills Chemicals, Inc., Tuscon, Ariz., entitled "LIX 64N. The Recovery of Copper from Ammoniacal Leach Solutions". As previously indicated, however, the ammoniacal leach solutions concerned did not contain chlorides.

As illustrated, the feed, constituting an ammoniacal etching solution containing copper values intermixed with chloride ions, is run through a filter to the usual mixer and settler units of liquid-liquid separation equipment. Such equipment may be utilized in as many extraction and stripping stages as deemed proper in any given instance, there being here shown two extraction stages designated E1 and E2, respectively, and two stripping stages designated S1 and S2, respectively.

The extractant employed as the organic medium is an alpha-hydroxy oxime, supplied by General Mills Chemicals, Inc. under the proprietary designation LIX 64N, in a liquid hydrocarbon vehicle pursuant to the process disclosed by Swanson U.S. Pat. No. 3,224,873. The aqueous feed solution is contacted by this organic extractant in units E1 and E2 to form a dispersion.

We have found that the organic phase extracts both the copper and the chloride ions from the spent ammoniacal etching solution and that the chloride ions can be selectively removed therefrom by scrubbing the loaded organic extractant with a weak sulfuric acid solution. Accordingly, as shown, the loaded organic phase is passed to a conventional scrubbing tank and scrubbed by a weak sulfuric acid solution for the selective removal of chloride ions in an aqueous solution which is normally sent to waste. The Cu-loaded, organic extract, substantially free of chloride ions, is passed to the first stripping stage S1, from which the copper-ion-loaded, aqueous raffinate is passed to an electrowinning cell or cells as the electrolyte therefor.

The stripping medium is a relatively strong sulfuric acid solution taken from the electrowinning cells and successively mixed with the scrubbed, chloride-free, organic extract in the stripping units S2 and S1. Some of such sulfuric acid solution (spent electrolyte) may be recycled directly to the electrowinning cells, as indicated, for building up sulfuric acid strength.

The end product of the electrowinning stage is a commercial "wire-grade" metallic copper as widely used in copper fabrication.

The aqueous effluent from the extraction stages E1 and E2, i.e. the raffinate, is barren ammoniacal etching solution which may carry residual amounts of the organic extractant. To complete the regeneration aspect of the process of this invention, such solution is treated for the removal of any organic residual. Such treatment may take a variety of forms. As here shown, the raffinate solution from the final extraction stage E2 is passed into a series of settling tanks, indicated as such on the drawing, from where any organic that is separated from the aqueous phase is recycled to the extraction stages. It is preferred to then pass the aqueous phase into a coalescer of standard type and to pass the effluent from that through one or more carbon columns to rid the aqueous solution of the last traces of organic. The resulting effluent constitutes the completely regenerated ammoniacal etching solution.

Since such regenerated ammoniacal etching solution is ordinarily somewhat depleted in its ammonia content it may be necessary to add ammonia, as indicated, to bring the solution up to appropriate etching strength. The end product is a regenerated etching solution that may be reused for etching purposes.

Whereas this invention is here illustrated and described with specific reference to an embodiment thereof presently contemplated as the best mode of carrying out such invention in actual practice, it is to be understood that various changes may be made in adapting the invention to different embodiments without departing fron the broader inventive concepts disclosed herein and comprehended by the claims that follow.

We claim:

1. A process for recovering copper values in metallic form from an aqueous, ammoniacal, etching solution containing the copper values along with chloride ions, said etching solution being derived from the etching of printed electronic circuit boards with a mixture of ammonium hydroxide and ammonium chloride, comprising the steps of:

a. intimately mixing the etching solution with an organic medium containing an exchange reagent which is capable of selectively extracting copper and chloride ions from said solution, thereby producing a dispersion comprising an aqueous phase and an organic phase, the organic phase containing the exchange reagent, the copper ions, and the chloride ions;
b. separating the phases of step (a);
c. intimately mixing the organic phase of step (b) with an aqueous, weakly acidic, scrubbing solution which is capable of selectively stripping the chloride ions from the organic phase to produce a dispersion comprising an aqueous acidic phase containing the chlorides, and an organic phase containing the exchange reagent and copper ions substantially free of chloride ions;
d. separating the phases of step (c);
e. intimately mixing the organic phase of step (d) with an aqueous acidic stripping solution which is capable of stripping copper ions from the organic phase, thereby producing a dispersion comprising an aqueous phase containing the copper ions substantially free of chloride ions, and an organic phase containing the exchange reagent;
f. separating the phases of step (e); and
g. electrowinning metallic copper from the aqueous phase containing the copper ions substantially free of chloride ions.

2. A process in accordance with claim 1, wherein the etching solution is ammoniacal; and wherein the exchange reagent is an alpha-hydroxy oxime.

3. A process in accordance with claim 1, wherein the ammoniacal etching solution is derived from the etching of printed electronic circuit boards with a mixture of ammonium hydroxide and ammonium chloride; and wherein the exchange reagent is an alpha-hydroxy oxime.

4. A process in accordance with claim 1, wherein the aqueous phase of step (b) is treated for the removal of residual organic, so as to constitute a regenerated etching solution capable of reuse.

5. A process in accordance with claim 4, wherein residual organic is removed by allowing the aqueous phase of step (b) to settle, thereby separating the organic phase therein from the aqueous phase, and by removing the organic phase separately from the aqueous phase.

6. A process in accordance with claim 5, wherein the separately removed aqueous phase from the settled aqueous phase of step (b) is further treated for the removal of remaining traces of organic.

7. A process in accordance with claim 6, wherein the further treatment specified in that claim comprises passing the separately removed aqueous phase through a coalescer and, thereafter, through a carbon column.

8. A process in accordance with claim 4, wherein the regenerated etching solution is treated to bring it up to full etching strength.

* * * * *